US007692608B2

(12) United States Patent
Jung et al.

(10) Patent No.: US 7,692,608 B2
(45) Date of Patent: Apr. 6, 2010

(54) ENERGY RECOVERY CIRCUIT AND ENERGY RECOVERING METHOD USING THE SAME

(75) Inventors: Yun Kwon Jung, Gumi-si (KR); Bong Koo Kang, Pohang-si (KR); Ju Won Seo, Pohang-si (KR); Sang Yoon Soh, Pohang-si (KR)

(73) Assignee: LG Electronics Inc., Seoul (KR)

( * ) Notice: Subject to any disclaimer, the term of this patent is extended or adjusted under 35 U.S.C. 154(b) by 1175 days.

(21) Appl. No.: 11/280,289

(22) Filed: Nov. 17, 2005

(65) Prior Publication Data

US 2006/0119547 A1 Jun. 8, 2006

(30) Foreign Application Priority Data

Dec. 4, 2004 (KR) ..... 10-2004-0101556

(51) Int. Cl.
*G09G 3/28* (2006.01)

(52) U.S. Cl. ..... 345/68; 345/60; 345/67

(58) Field of Classification Search ..... 345/60–69, 345/76–104, 204–215
See application file for complete search history.

(56) References Cited

U.S. PATENT DOCUMENTS 7,027,010 B2 * 4/2006 Lee ..... 345/60
2003/0080925 A1 * 5/2003 Lee ..... 345/60

FOREIGN PATENT DOCUMENTS

| | | |
|---|---|---|
| CN | 1767125 | 5/2006 |
| JP | 09-062226 | 3/1997 |
| JP | 11-015426 | 1/1999 |
| JP | 2004-021261 | 1/2004 |
| KR | 10-2003-0095618 A | 12/2003 |

OTHER PUBLICATIONS

Chinese Office Action dated Feb. 15, 2008.
Korean Office Action dated Jul. 28, 2006.
Japanese Office Action dated Sep. 24, 2008.

* cited by examiner

*Primary Examiner*—Vijay Shankar
(74) *Attorney, Agent, or Firm*—KED & Associates, LLP

(57) ABSTRACT

An energy recovery circuit is provided that includes: a panel capacitor formed equivalently in a scan electrode and a sustain electrode, a scan electrode driver installed at a side of the scan electrode of the panel capacitor to supply a sustaining pulse to the side of the scan electrode, and a sustain electrode driver installed at a side of the sustain electrode of the panel capacitor to supply the sustaining pulse to the side of the sustain electrode. The energy recovery circuit may further include a first diode coupled to the scan electrode side of the panel capacitor, a second diode coupled to the sustain electrode side of the panel capacitor, a first inductor commonly coupled to the sustain electrode side and the scan electrode side of the panel capacitor, a path providing part coupled to the first inductor, and a single source capacitor connected to the path providing part.

13 Claims, 13 Drawing Sheets

ENERGY RECOVERY CIRCUIT AND ENERGY RECOVERING METHOD USING THE SAME

This application claims the benefit of Korean Patent Application No. P2004-101556 filed Dec. 4, 2004, which is hereby incorporated by reference.

BACKGROUND OF THE INVENTION

1. Field of the Invention

The present invention relates to an energy recovery circuit and energy recovering method using the same, and more particularly, to an energy recovery circuit and energy recovering method using the same that is capable of reducing the number of components.

2. Description of the Related Art

Recently, there have been developed various flat panel display devices reduced in weight and bulk that is capable of eliminating disadvantages of a cathode ray tube (CRT). Such flat panel display devices include a liquid crystal display (LCD), a field emission display (FED), a plasma display panel (PDP) and an electro-luminescence (EL) display, etc.

The PDP among them is a display device using gas discharge and has an advantage that it can be easily produced in a large sized panel. As shown in FIG. 1, a three electrode AC surface discharge PDP is typical as the PDP, wherein it has three electrodes and is driven by AC voltage.

Referring to FIG. 1, a discharge cell of a three-electrode, AC surface-discharge PDP includes a scan electrode 12Y and a sustain electrode 12Z provided on an upper substrate 10, and an address electrode 20X provided on a lower substrate 18.

On the upper substrate 10 provided, in parallel, with the scan electrode 12Y and the sustain electrode 12Z, an upper dielectric layer 14 and a protective film 16 are disposed. Wall charges generated upon plasma discharge are accumulated onto the upper dielectric layer 14. The protective film 16 prevents a damage of the upper dielectric layer 14 caused by a sputtering during the plasma discharge and improves the emission efficiency of secondary electrons. This protective film 16 is usually made of magnesium oxide (MgO).

A lower dielectric layer 22 and barrier ribs 24 are formed on the lower substrate 18 provided with the address electrode 20X. The surfaces of the lower dielectric layer 22 and the barrier ribs 24 are coated with a phosphorous material 26. The address electrode 20X is formed in a direction crossing the scan electrode 12Y and the sustain electrode 12Z. The barrier rib 24 is formed in parallel to the address electrode 20X to thereby prevent an ultraviolet ray and a visible light generated by a discharge from being leaked to the adjacent discharge cells.

The phosphorous material 26 is excited by an ultraviolet ray generated during the plasma discharge to generate any one of red, green and blue visible light rays. An inactive mixture gas for a gas discharge is injected into a discharge space defined between the upper and lower substrates 10 and 18 and the barrier rib 24.

The three electrode AC surface discharge PDP is divided into a plurality of subfields to be driven, wherein the light emission of numbers proportional to the weight of a video data is in progress in each subfield period, thereby performing the gray level display. The subfield is re-divided into an initialization period, an address period, a sustain period and an erasure period to be driven.

Herein, the initialization period is a period when uniform wall charges are formed in a discharge cell, the address period is a period when a selective address discharge is generated in accordance with the logical value of the video data, the sustain period is a period when a discharge is kept in the discharge cell where the address discharge is generated, and the erasure period is a period when the sustain discharge generated during the sustain period is eliminated.

In AC surface discharge PDP driven like this way, a high voltage of not less than several hundreds of volts is required in the address discharge and the sustain discharge thereof. Accordingly, an energy recovery circuit is used for minimizing a drive power required in the address discharge and the sustain discharge. The energy recovery circuit recovers the voltage between the scan electrode 12Y and the sustain electrode 12Z, and utilizes the recovered voltage as a drive voltage for the next discharge.

FIG. 2 is a diagram illustrating an energy recovery circuit installed for recovering a voltage of the sustain discharge.

Referring to FIG. 2, energy recovery circuits 30, 32 of the related art PDP are symmetrically installed with a panel capacitor Cp, therebetween. Herein, the panel capacitor Cp equivalently represents the capacitance which is formed between the scan electrode Y and the sustain electrode Z. In the energy recovery circuits, a first energy recovery circuit 30 supplies a sustain voltage to the scan electrode Y and a second energy recovery circuit 32 supplies the sustain voltage to the sustain electrode Z while it alternately operates with the first energy recovery circuit 30.

The composition of the energy recovery circuits 30, 32 of the related art PDP is described in reference with the first energy recovery circuit 30. The first energy recovery circuit 30 includes an inductor L connected between a panel capacitor Cp and a source capacitor Cs; first and third switches S1, S3 connected in parallel between the source capacitor Cs and the inductor L; and second and fourth switches S2, S4 connected in parallel between the panel capacitor Cp and the inductor L.

The second switch S2 is connected to a sustain voltage source Vs, and the fourth switch S4 is connected to a ground voltage source GND. The source capacitor Cs recovers the voltage charged into the panel capacitor upon the sustain discharge to be charged and re-supplies the charged voltage to the panel capacitor Cp. The voltage of Vs/2 corresponding to the half value of the sustain voltage source Vs is charged in the source capacitor Cs. The inductor L forms a resonance circuit together with the panel capacitor Cp. For this, the first to fourth switches S1 to S4 control the flow of electric current.

On the other hand, fifth and sixth diodes D5, D6 each installed between the first and third switches S1, S3 and the inductor L prevent the current from flowing in a reverse direction.

FIG. 3 is a timing diagram and waveform diagram representing an output waveform of a panel capacitor and an on/off timing of switches of the first energy recovery circuit.

Before a T1 period, assuming that a voltage of 0 volt is charged in the panel capacitor Cp and a voltage of Vs/2 is charged in the source capacitor Cs, the operation process is described in detail.

In the T1 period, a first switch S1 is turned on to form a current path from the source capacitor Cs to the panel capacitor Cp through the first switch S1 and the inductor L. Accordingly, the voltage of Vs/2 charged in the source capacitor Cs is supplied to the panel capacitor Cp. At this moment, the inductor L and the panel capacitor Cp forms a series resonance circuit, thus the sustain voltage Vs which is double of the voltage of the source capacitor Cs is charged in the panel capacitor Cp.

In a T2 period, the second switch S2 is turned on. When the second switch S2 is turned on, the voltage from the sustain voltage source Vs is supplied to the scan electrode Y. The voltage of the sustain voltage source Vs supplied to the scan electrode Y prevents the voltage of the panel capacitor Cp from dropping below the sustain voltage source Vs to cause the sustain discharge to be generated in a normal manner. On the other hand, the voltage of the panel capacitor Cp rises to the sustain voltage Vs in the t1 period, thus the drive power supplied from the outside to generated the sustain discharge is minimized.

In a T3 period, the first switch S1 is turned off. At this moment, the scan electrode Y maintains the voltage of the sustain voltage source Vs for the T3 period. In a T4 period, the second switch S2 is turned off and the third switch is turned on. When the third switch S3 is turned on, there is formed a current path from the panel capacitor Cp to the source capacitor Cs through the inductor L and the third switch S3 to recover the voltage charged in the panel capacitor Cp to the source capacitor Cs. At this moment, the source capacitor Cs is charged with the voltage of Vs/2.

In a T5 period, the third switch S3 is turned off and the fourth switch S4 is turned on. When the fourth switch S4 is turned on, a current path is formed between the panel capacitor Cp and the ground voltage source GND, thus the voltage of the panel capacitor Cp drops to 0V. In a T6 period, it maintains at the T5 state for a designated period. In fact, an AC drive pulse supplied to the scan electrode Y and the sustain electrode Z is obtained while the T1 to T6 periods are repeated periodically.

On the other hand, as shown in FIG. 4, the second energy recovery circuit 32 supplies the drive voltage to the panel capacitor Cp while alternately operating with the first energy recovery circuit 30. Accordingly, the panel capacitor Cp receives the sustain pulse voltage Vs that has a different polarity as shown in FIG. 4. In this way, the sustain pulse voltage Vs having the different polarities is supplied to the panel capacitor Cp, thus the sustain discharge is generated at the discharge cells.

However, since the first energy recovery circuit 30, installed at a side of the scan electrode Y, and the second energy recovery circuit 32, installed at a side of the sustain electrode Z, are respectively operated, lots of circuit components such as switching device are required. Accordingly, there is a problem that a manufacturing cost thereof becomes increased. In addition, if lots of circuit components are installed to the energy recovery circuits 30, 32, then a large amount of power consumption becomes wasted.

SUMMARY OF THE INVENTION

Accordingly, it is an object of the present invention to provide an energy recovery circuit and energy recovering method using the same that is capable of reducing the number of components.

In order to achieve these and other objects of the invention, an energy recovery circuit according to the present invention includes: a panel capacitor formed equivalently in a scan electrode and a sustain electrode; a scan electrode driver installed at a side of the scan electrode of the panel capacitor to supply a sustaining pulse to the side of the scan electrode; a sustain electrode driver installed at a side of the sustain electrode of the panel capacitor to supply the sustaining pulse to the side of the sustain electrode; one source capacitor commonly connected to the scan electrode driver and the sustain electrode driver to supply a voltage to the panel capacitor and to charge with a voltage discharged in the panel capacitor; and a path providing part to a current path of both the panel capacitor and the source capacitor when a voltage is supplied from the panel capacitor to the source capacitor.

The energy recovery circuit, further includes: a first inductor located between the source capacitor and the panel capacitor to form a resonance circuit when the voltage is supplied from the source capacitor to the panel capacitor; a second inductor located between the source capacitor and the panel capacitor to a resonance circuit when the voltage is supplied from the panel capacitor to the source capacitor; a first diode located between the first inductor and the source capacitor; a second diode located between the scan electrode side of the panel capacitor and the second inductor; and a third diode located between the sustain electrode side of the panel capacitor and the second inductor.

The path providing part includes a switch located between the second inductor and the source capacitor to be turned on when the voltage charged in the panel capacitor is supplied to the source capacitor.

The scan electrode driver includes: a first switch located between a sustain voltage source and the panel capacitor; a second switch located between a ground voltage source and the panel capacitor; and a third switch located between the panel capacitor and the first inductor to be turned on when the voltage is supplied from the source capacitor to the scan electrode side of the panel capacitor.

The energy recovery circuit further includes a fourth diode located between the second inductor and the sustain voltage source to prevent that a voltage of the second inductor rises more than the sustain voltage.

The sustain electrode driver includes: a first switch located between a sustain voltage source and the panel capacitor; a second switch located between a ground voltage source and the panel capacitor; and a third switch located between the panel capacitor and the first inductor to be turned on when a voltage is supplied from the source capacitor to the sustain electrode side of the panel capacitor.

The energy recovery circuit further includes a fourth diode located between the first inductor and the sustain voltage source to prevent that a voltage of the first inductor rises more than the sustain voltage.

An energy recovery circuit according to the present invention includes: a capacitive load between a first electrode and a second electrode; a source capacitor to recover energy from the capacitive load via the first an the second electrodes; a recovery path switch to form a recovery path for supplying energy via the first and the second electrodes from the capacitive load to a side of the source capacitor; and a plurality of charge path switches to control a charge path for supplying energy from the source capacitor to a side of the capacitive load.

The energy recovery circuit further includes: a sustain voltage source for generating a high potential voltage of a sustaining pulse; a first inductor formed on the charge path; a second inductor formed between the first electrode and source capacitor on the recovery path; a first diode connected between the second inductor and the sustain voltage source; a second diode connected between a node of both the source capacitor and the first inductor and the sustain voltage source; and a third diode connected between the source capacitor and the first inductor.

The charge path switches include: a first switch connected between the sustain voltage source and the first electrode; a third switch between the first electrode and one side terminal of the first inductor; a fourth switch connected between the sustain voltage source and the second electrode; and a sixth switch connected between the second electrode and one side terminal of the first inductor.

The recovery path switch is connected between a node of both another side terminal of the first inductor and the source capacitor and the second inductor.

The energy recovery circuit further includes a fourth diode connected between the first electrode and the second inductor.

The energy recovery circuit further includes: a second switch connected between a ground voltage source and the first electrode; and a fifth switch connected between the ground voltage source and the second electrode.

The energy recovery circuit further includes a fifth diode connected between a node of both the first diode and the fourth diode and the second electrode.

A method of recovering energy according to the present invention includes: supplying a voltage discharged from a source capacitor via a first current path to a side of a scan electrode of a panel capacitor; supplying a voltage discharge from the scan electrode side of the panel capacitor via a second current path to the source capacitor; supplying a voltage discharge from the source capacitor via a third current path to a side of a sustain electrode of the panel capacitor; and supplying a voltage discharged from the sustain electrode side of the panel capacitor via a fourth current path to the source capacitor.

A first inductor for forming a resonance circuit along with the panel capacitor is included on the first current path and the third current path.

The method further includes: including a second inductor for forming a resonance circuit along with the panel capacitor on the second current path and the fourth current path; and forming a current path from the first inductor and the second inductor to the sustain voltage source when the voltage of the first inductor and the second inductor rises more than the sustain voltage to discharge an over current.

The voltage discharged from the scan electrode side of the panel capacitor is supplied via a first diode to the second current path, and the voltage discharge from the sustain electrode side of the panel capacitor is supplied via a second diode to the fourth current path.

A method of recovering energy from a display panel having a capacitive load between a first electrode and a second electrode, according to the present invention includes: charging the first electrode with energy stored in the source capacitor; charging the first electrode with a high potential voltage from a sustain voltage source; recovering energy from the capacitive load via the first electrode to the source capacitor; charging the second electrode with energy stored in the source capacitor; charging the second electrode with the high potential voltage; and recovering energy from the capacitive load via the second electrode to the source capacitor, wherein a recovery path from the capacitive load to the source capacitor side is switched by a recovery path switch connected between the first electrode and the source capacitor.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

Hereinafter, the preferred embodiments of the present invention will be described in detail with reference to FIGS. 5 to 13.

Figure 1:
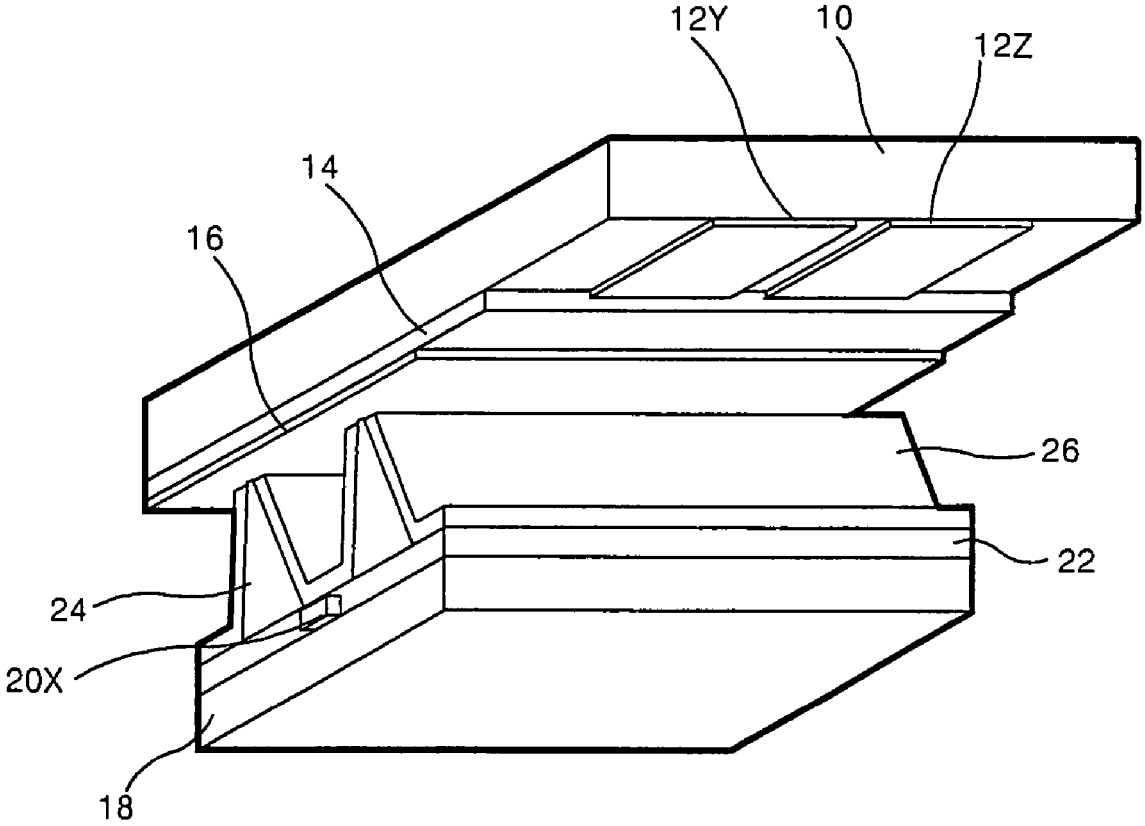
FIG. 1 RELATED ART
FIG. 1 is a perspective view showing a related art three electrode AC surface-discharge plasma display panel.
Figure 2:
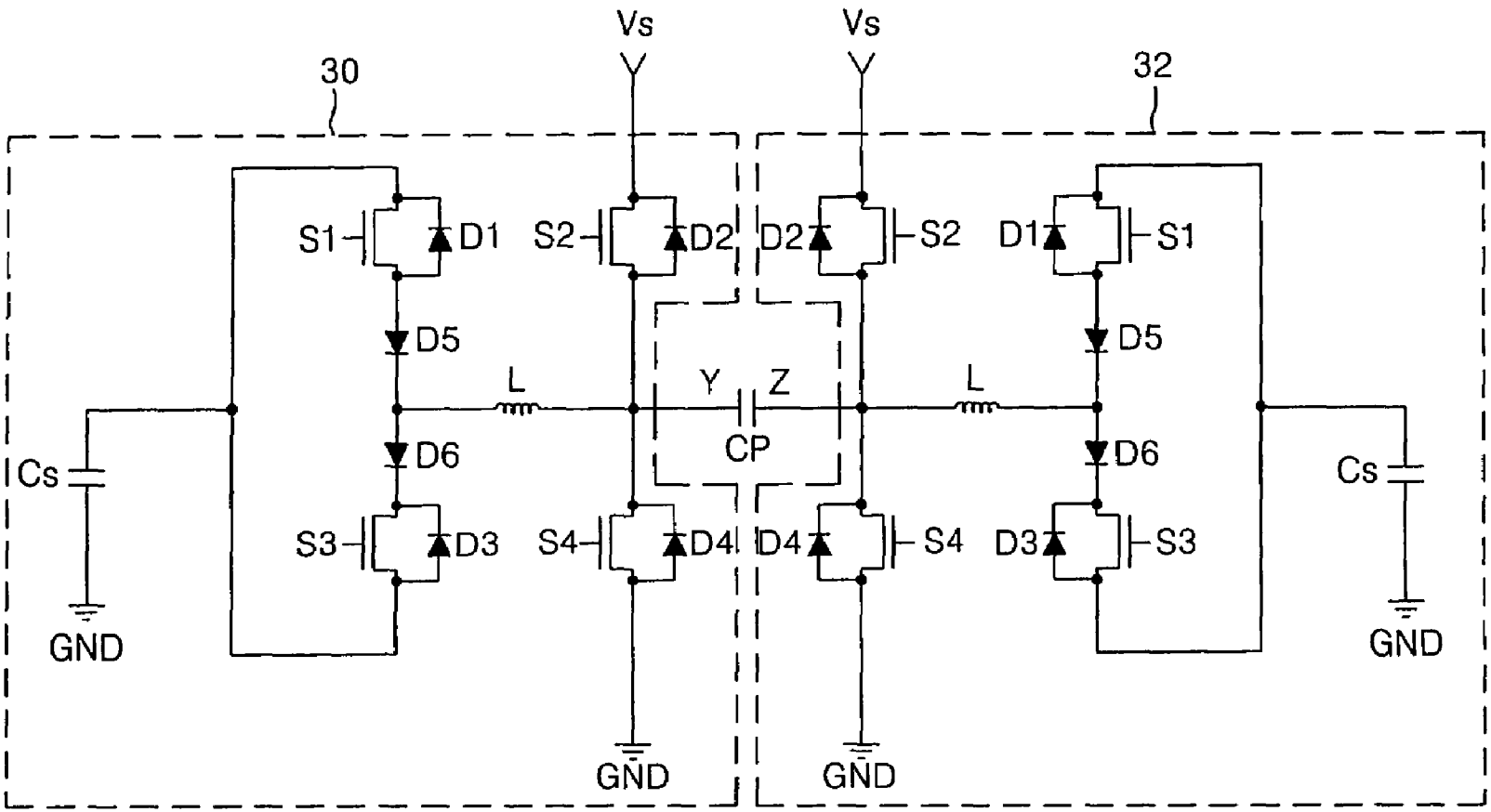
FIG. 2 RELATED ART
FIG. 2 is a circuit diagram representing an energy recovery circuit for recovering a voltage of a sustain discharge.
Figure 3:
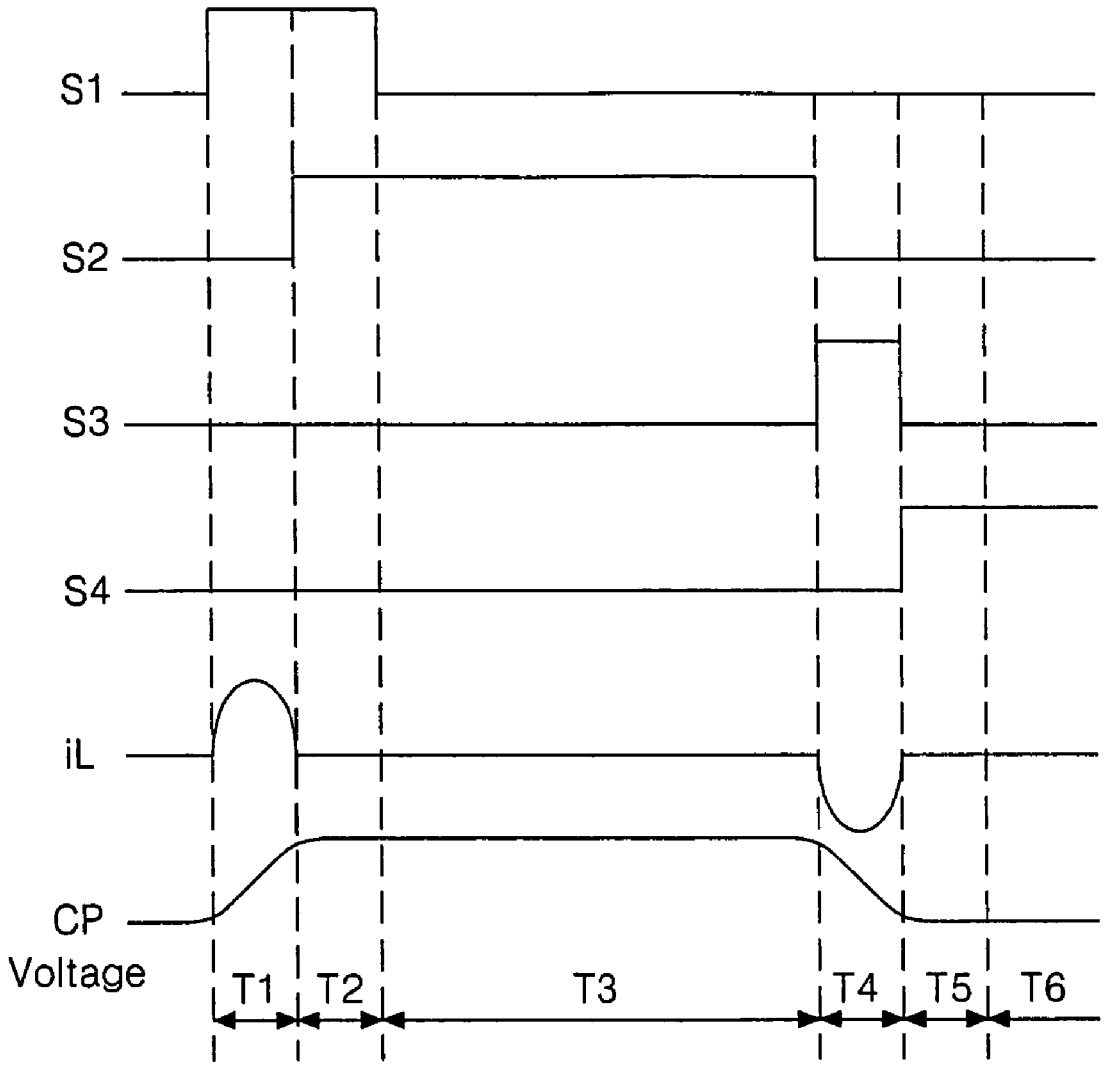
FIG. 3 RELATED ART
FIG. 3 is a timing diagram representing an on/off timing of switches shown in FIG. 2.
Figure 4:
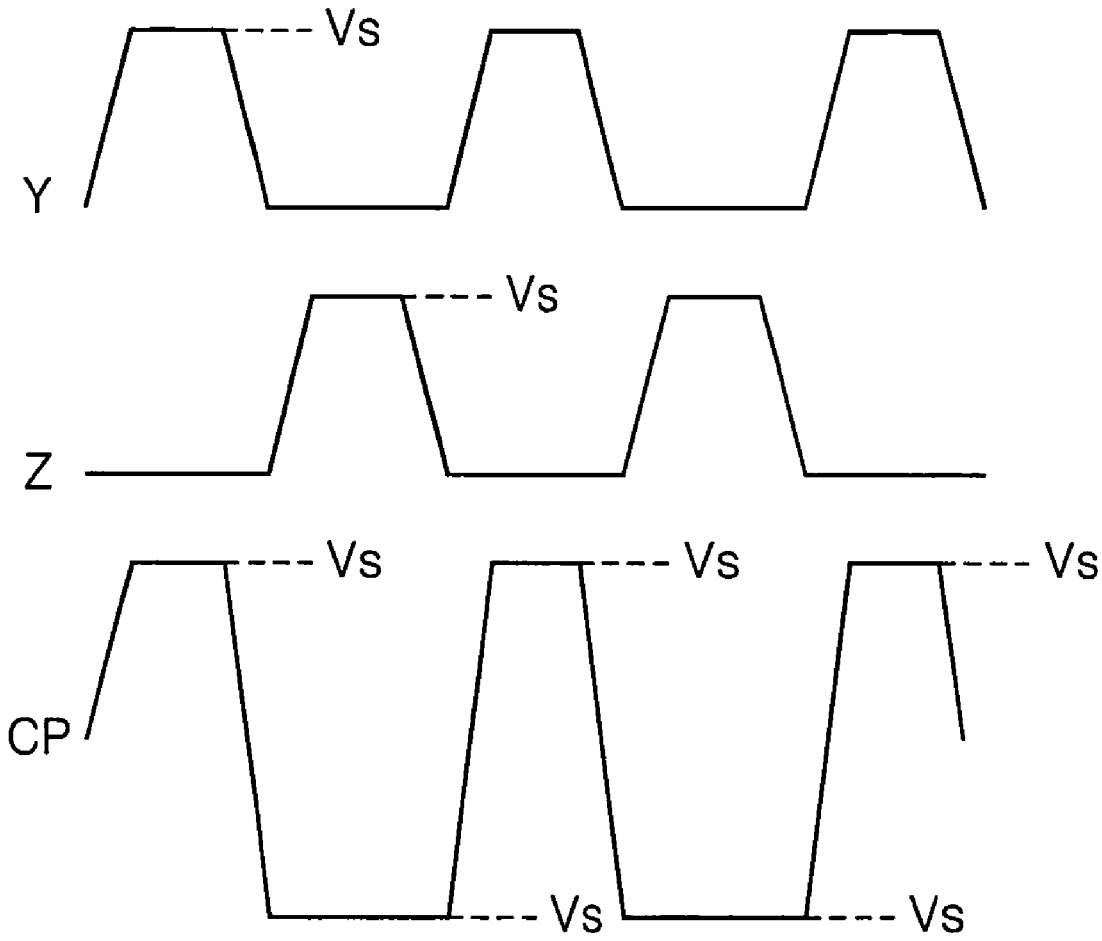
FIG. 4 RELATED ART
FIG. 4 is a diagram representing a sustain pulse supplied by the energy recovery circuit shown in FIG. 2.
Figure 5:
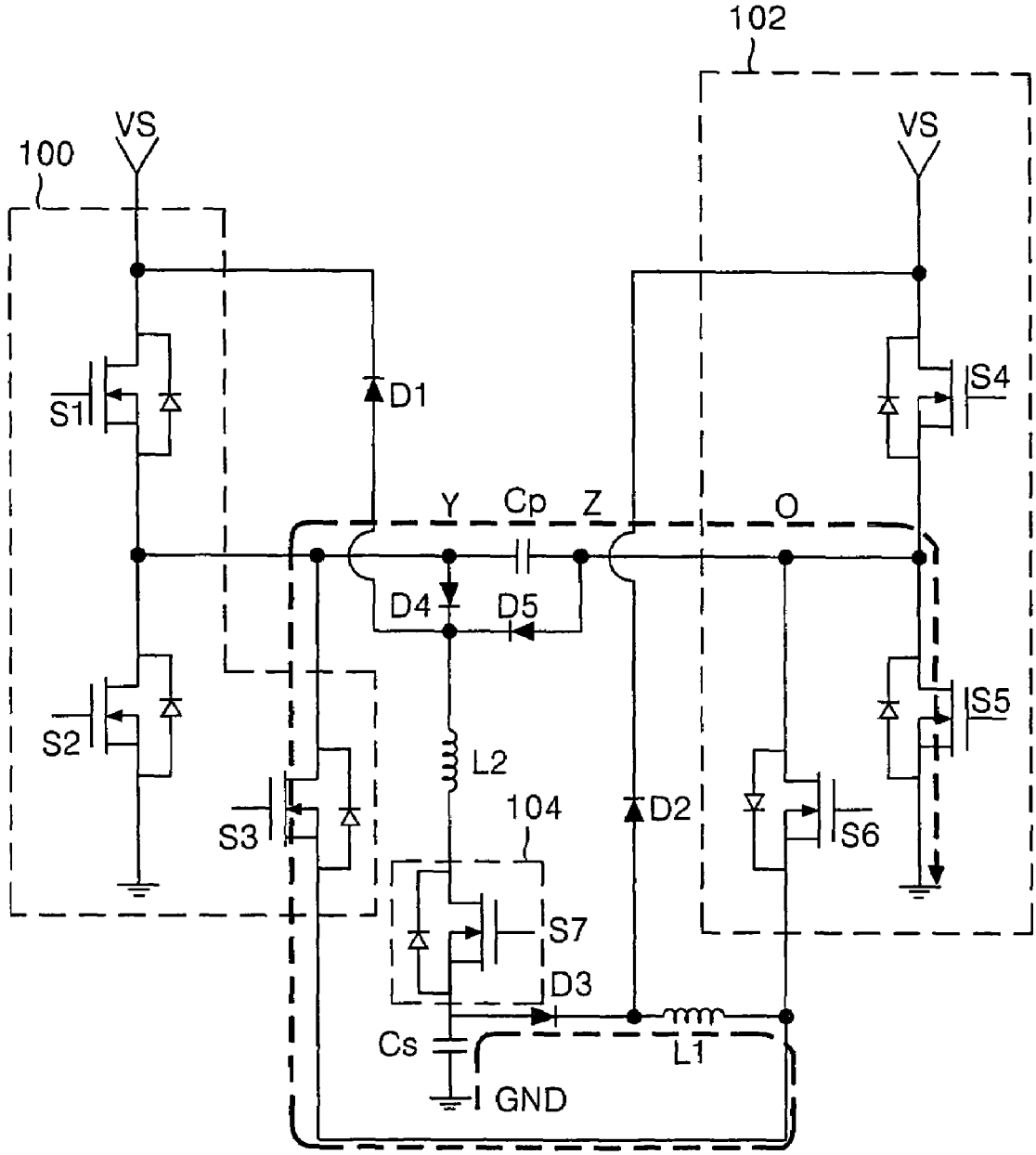
FIG. 5 is a circuit diagram illustrating an energy recovery circuit according to an embodiment of the present invention.

FIG. 5 is a circuit diagram illustrating an energy recovery circuit according to an embodiment of the present invention.

Referring to FIG. 5, the energy recovery circuit according to the present invention includes: a panel capacitor Cp; a scan electrode driver 100 and a sustain electrode driver 102, which are symmetrically installed with the panel capacitor Cp therebetween; a source capacitor Cs for charging/discharging energy together with the panel capacitor Cp; and a path providing part 104 for providing an energy charge path of the source capacitor Cs.

The panel capacitor Cp equivalently represents the capacitance which is formed between the scan electrode Y and the sustain electrode Z. The scan electrode driver 100 is used for supplying a sustain voltage Vs to a side of the scan electrode Y of the panel capacitor Cp. The sustain electrode driver 102 is used for supplying the sustain voltage Vs to a side of a sustain electrode Z of the panel capacitor Cp.

The path providing part 104 is located between the panel capacitor Cp and the source capacitor Cs to provide a current path when a voltage charged into the panel capacitor Cp is recovered to the source capacitor Cs. The source capacitor Cs charges/discharges a predetermined voltage together with the panel capacitor Cp.

As set forth above, the present invention includes only one source capacitor Cs for recovering the voltage charged into the panel capacitor Cp and providing the recovered voltage to the panel capacitor Cp. In other words, the scan electrode Y and the sustain electrode Z of the panel capacitor cp receive the voltage supplied from one source capacitor Cs. In this way, when only one source capacitor Cs is added in the energy recovery circuit, it is possible to reduce the number of mounted components as compared with the related art.

And, in the present invention, when the voltage is recovered from the panel capacitor Cp to the source capacitor Cs, the path providing part 104 forms a current path. In other words, when the voltage is recovered from the panel capacitor Cp to the source capacitor Cs, each of the scan electrode driver 100 and the sustain electrode driver 102 does not provide a current path. One path providing part 104 provides a current path, thus, it is possible to minimize the number of mounted components.

Further, the energy recovery circuit according to the present invention includes: a first inductor L1 to form a resonant circuit together with the panel capacitor Cp when the panel capacitor Cp is charged; a second inductor L2 to form a resonant circuit together with the source capacitor Cs when the source capacitor Cs is charged; a fourth diode D4 located between a side of the scan electrode Y of the panel capacitor Cp and the second inductor L2; a fifth diode D5 located between a side of the sustain electrode Z of the panel capacitor Cp and the second inductor L2; a third diode D3 located between the first inductor L1 and the source capacitor Cs; a first diode located between the second inductor L2 and the sustain voltage source Vs; and a second diode D2 located between the first inductor L1 and the sustain voltage source Vs.

When the voltage charged into the source capacitor Cs is discharged, the first inductor L1 forms a resonance circuit together with the panel capacitor Cp. When the voltage charged into the panel capacitor Cp is discharged, the second inductor L2 forms a resonance circuit together with the source capacitor Cs. The third to the fifth diode D3 to D5 prevent that a reverse current flows.

When a direction of the current flowing to the second inductor L2 is changed, the first diode D1 maintains a reverse voltage induced to the second inductor L2 in less than the sustain voltage Vs. In other words, the first diode D1 is installed between the second inductor L2 and the sustain voltage source Vs to form a current path of both the second inductor L2 and the sustain voltage source Vs when a reverse voltage more than the sustain voltage Vs is induced to the second inductor L2.

When a direction of the current flowing to the first inductor L1 is changed, the second diode D2 maintains a reverse voltage induced to the first inductor L1 in less than the sustain voltage Vs. In other words, the second diode D2 is installed between the first inductor L1 and the sustain voltage source Vs to form a current path of both the first inductor L1 and the sustain voltage source Vs when a reverse voltage more than the sustain voltage Vs is induced to the first inductor L1.

The scan electrode driver 100 includes: a first switch S1 installed between the panel capacitor Cp and the sustain voltage source Vs; a second switch S2 installed between the panel capacitor Cp and the ground voltage source; and a third switch S3 installed between the panel capacitor Cp and the first inductor L1.

The first switch S1 is turned on when the sustain voltage Vs is supplied to the panel capacitor Cp. The second switch S2 is turned on when the ground voltage is supplied to the panel capacitor cp. The third switch S3 is turned on when the voltage is supplied to the side of the scan electrode Y of the panel capacitor Cp from the source capacitor Cs.

The sustain electrode driver 102 includes: a fourth switch S4 installed between the panel capacitor Cp and the sustain voltage Vs; a fifth switch S5 installed between the panel capacitor Cp and the ground voltage source; and a sixth switch S6 installed between the panel capacitor Cp and the first inductor L1.

The fourth switch S4 is turned on when the sustain voltage Vs is supplied to the panel capacitor Cp. The fifth switch S5 is turned on when the ground voltage is supplied to the panel capacitor Cp. The sixth switch S6 is turned on when the voltage is supplied to the side of the sustain electrode Z of the panel capacitor Cp from the source capacitor Cs.

Figure 6:
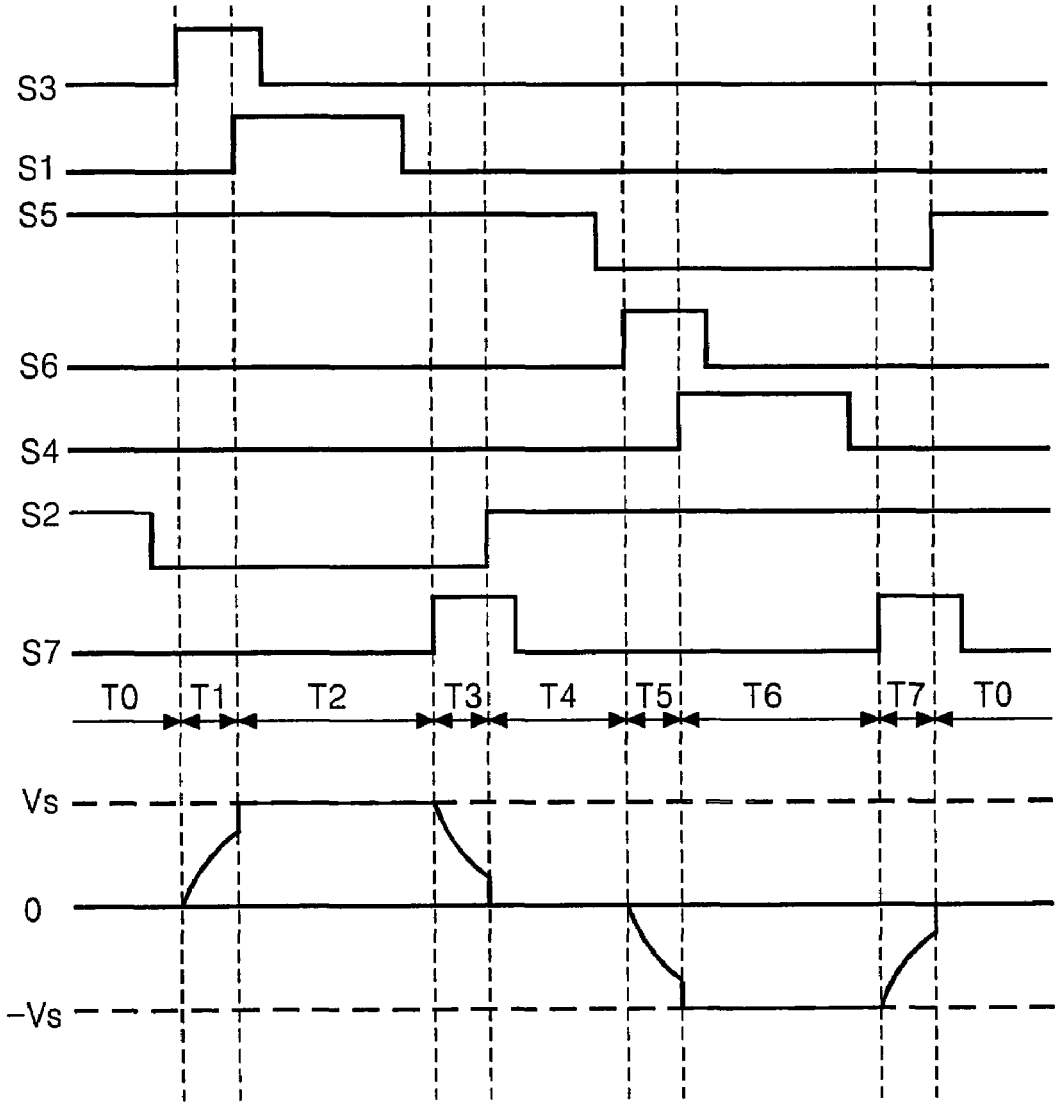
FIG. 6 is a timing diagram representing an on/off timing of switches shown in FIG. 5.
Figure 7:
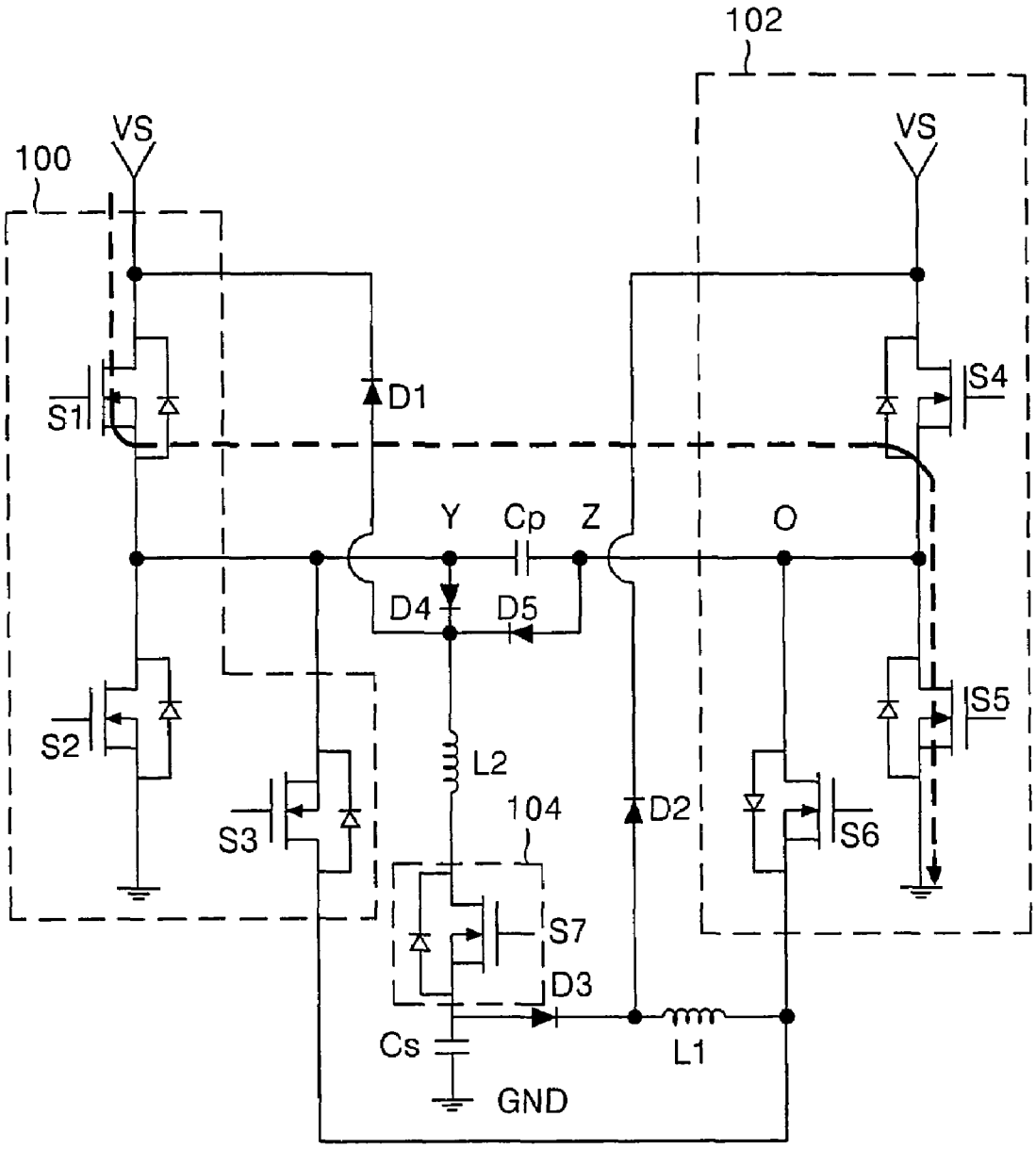
FIG. 7 is a circuit diagram representing a process which a sustain voltage is supplied to a side of a scan electrode of a panel capacitor in the energy recovery circuit shown in FIG. 5.
Figure 8:
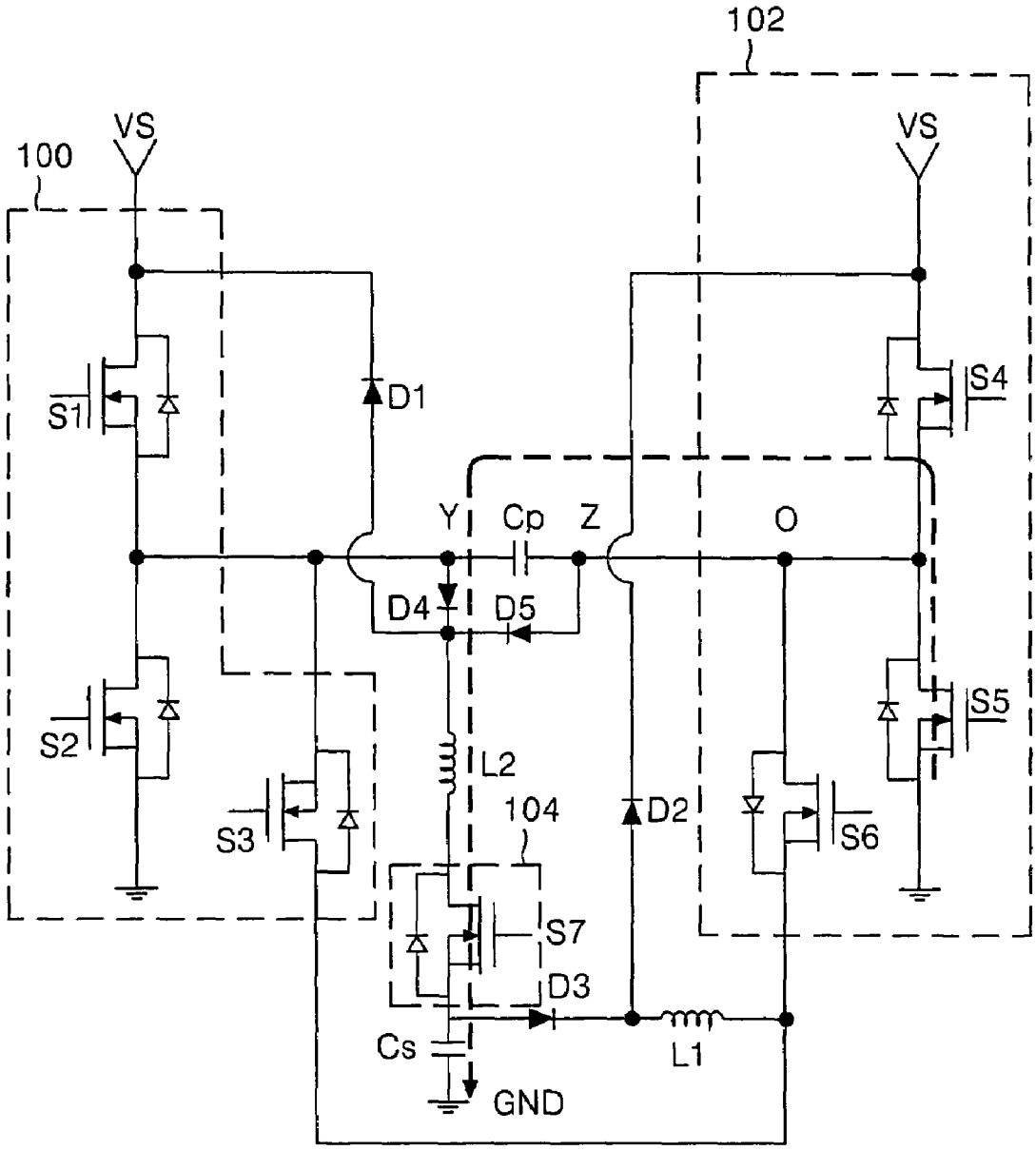
FIG. 8 is a circuit diagram representing a process which the voltage is supplied from the side of the scan electrode of the panel capacitor to a source capacitor in the energy recovery circuit as shown in FIG. 5.
Figure 9:
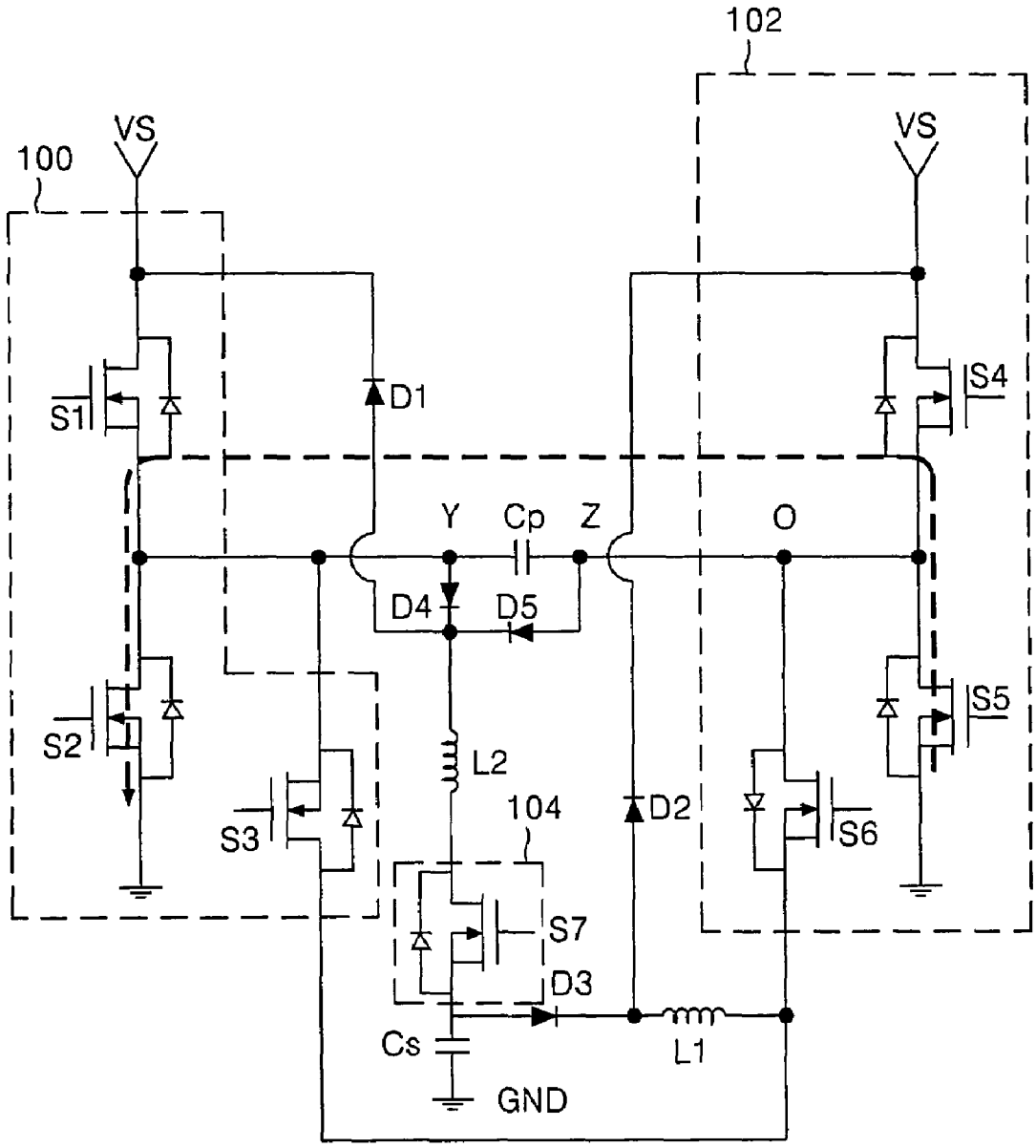
FIG. 9 is a circuit diagram representing a process which a ground voltage is supplied to both ends of the panel capacitor in the energy recovery circuit shown in FIG. 5.
Figure 10:
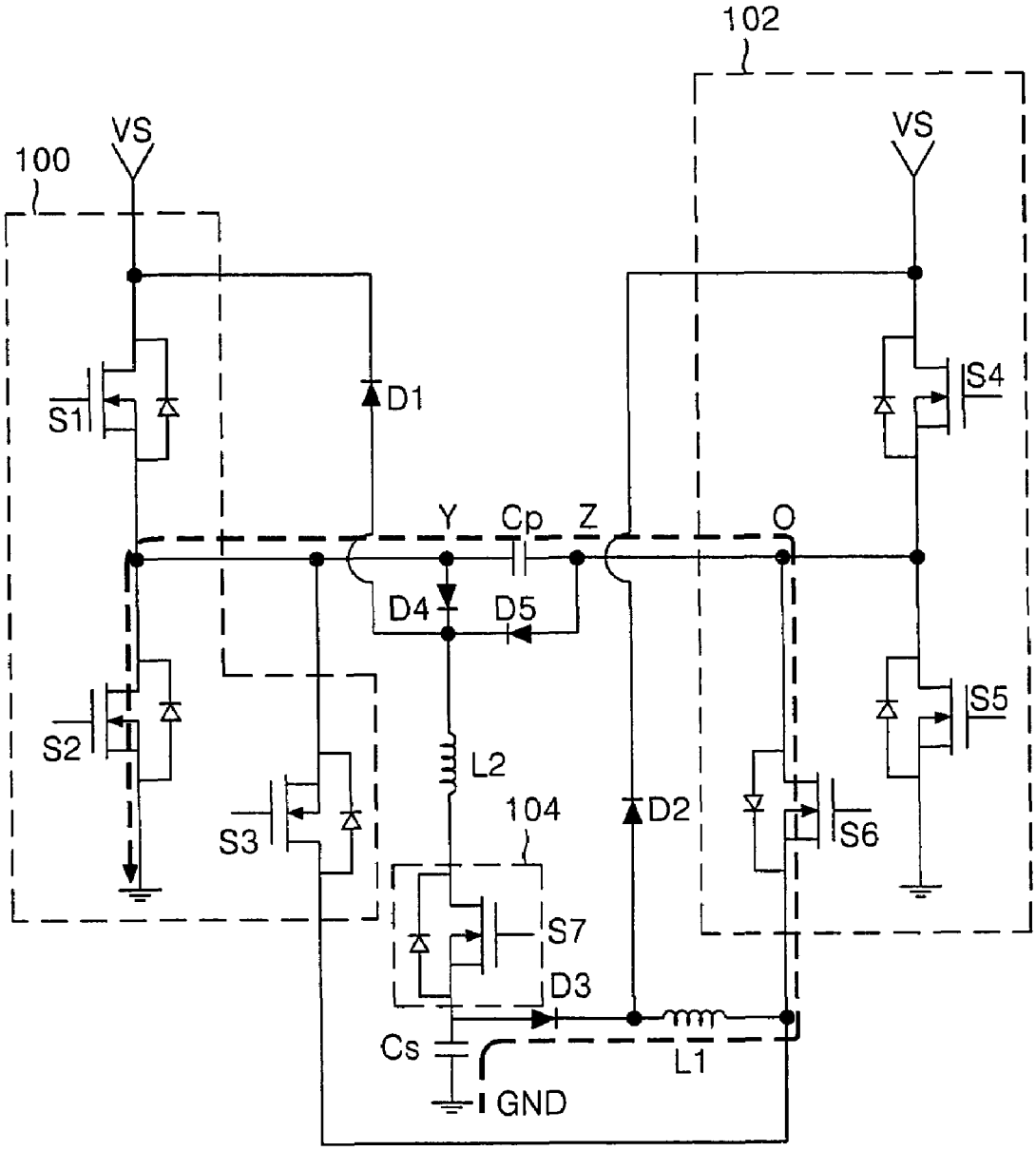
FIG. 10 is a circuit diagram representing a process which the voltage is supplied from the source capacitor to a side of a sustain electrode of the panel capacitor in the energy recovery circuit shown in FIG. 5.
Figure 11:
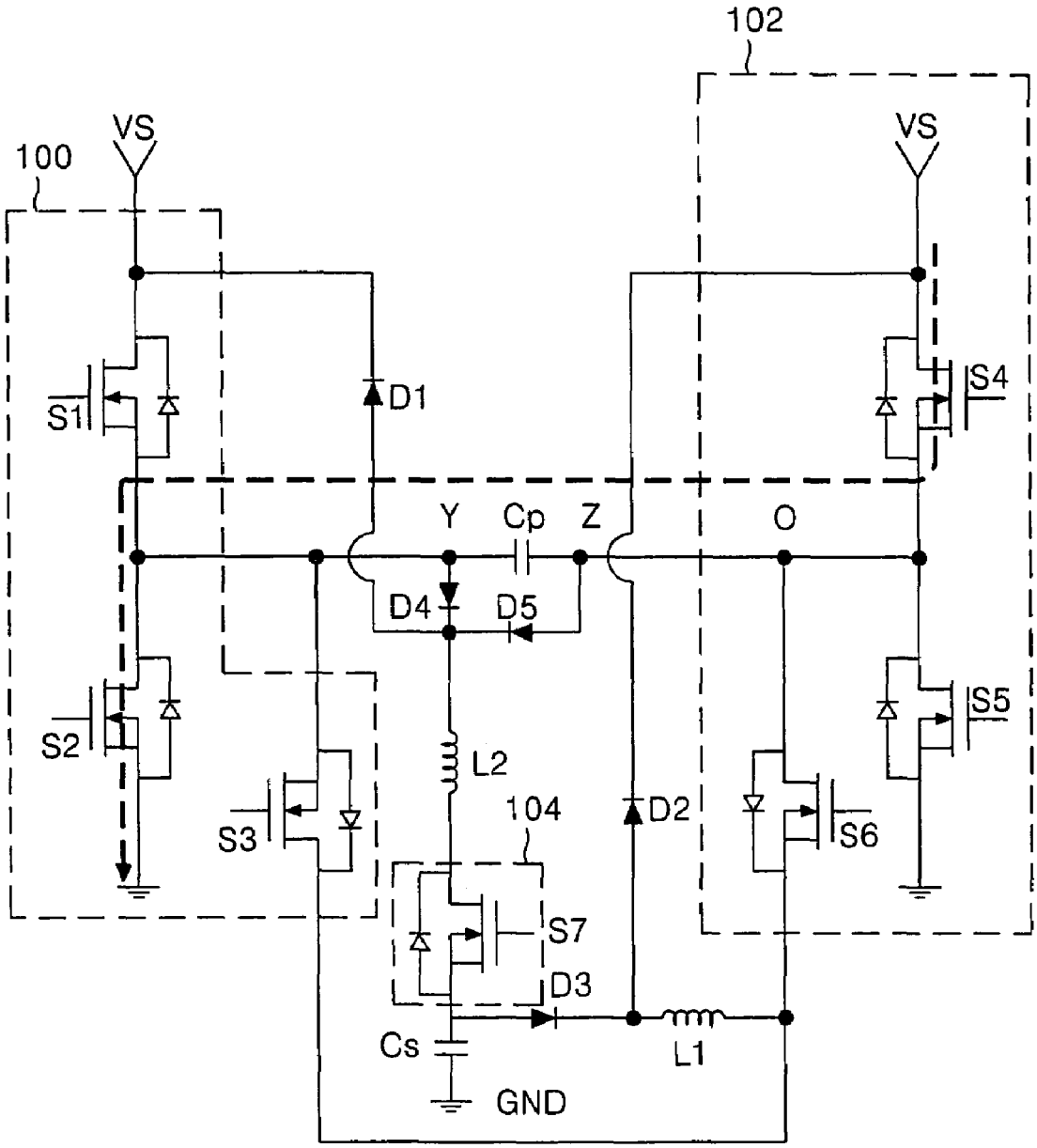
FIG. 11 is a circuit diagram representing a process which the sustain voltage is supplied to the side of the sustain electrode of the panel capacitor in the energy recovery circuit shown in FIG. 5.
Figure 12:
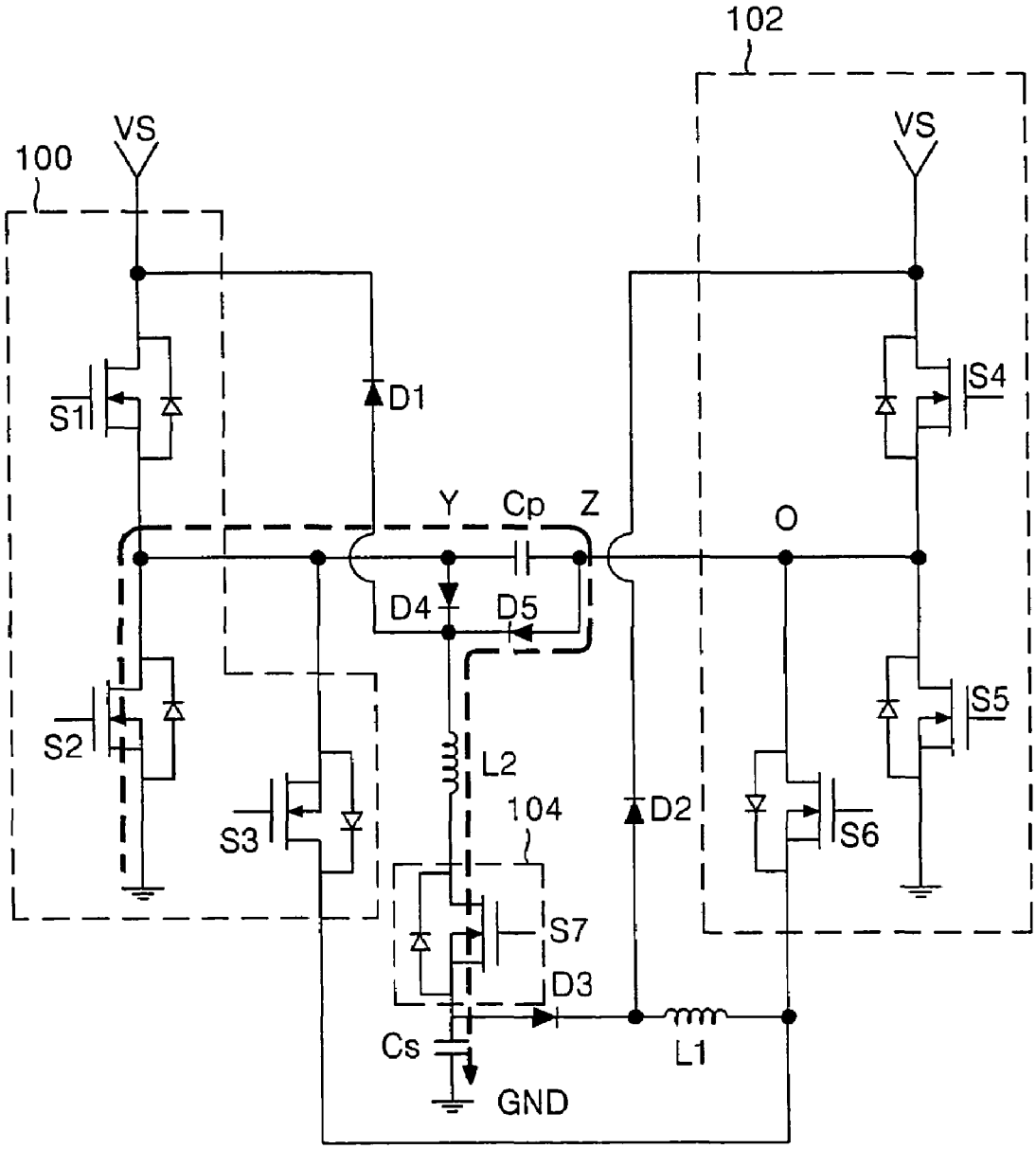
FIG. 12 is a circuit diagram representing a process which the voltage is supplied form the side of the sustain electrode of the panel capacitor to the source capacitor in the energy recovery circuit shown in FIG. 5.
Figure 13:
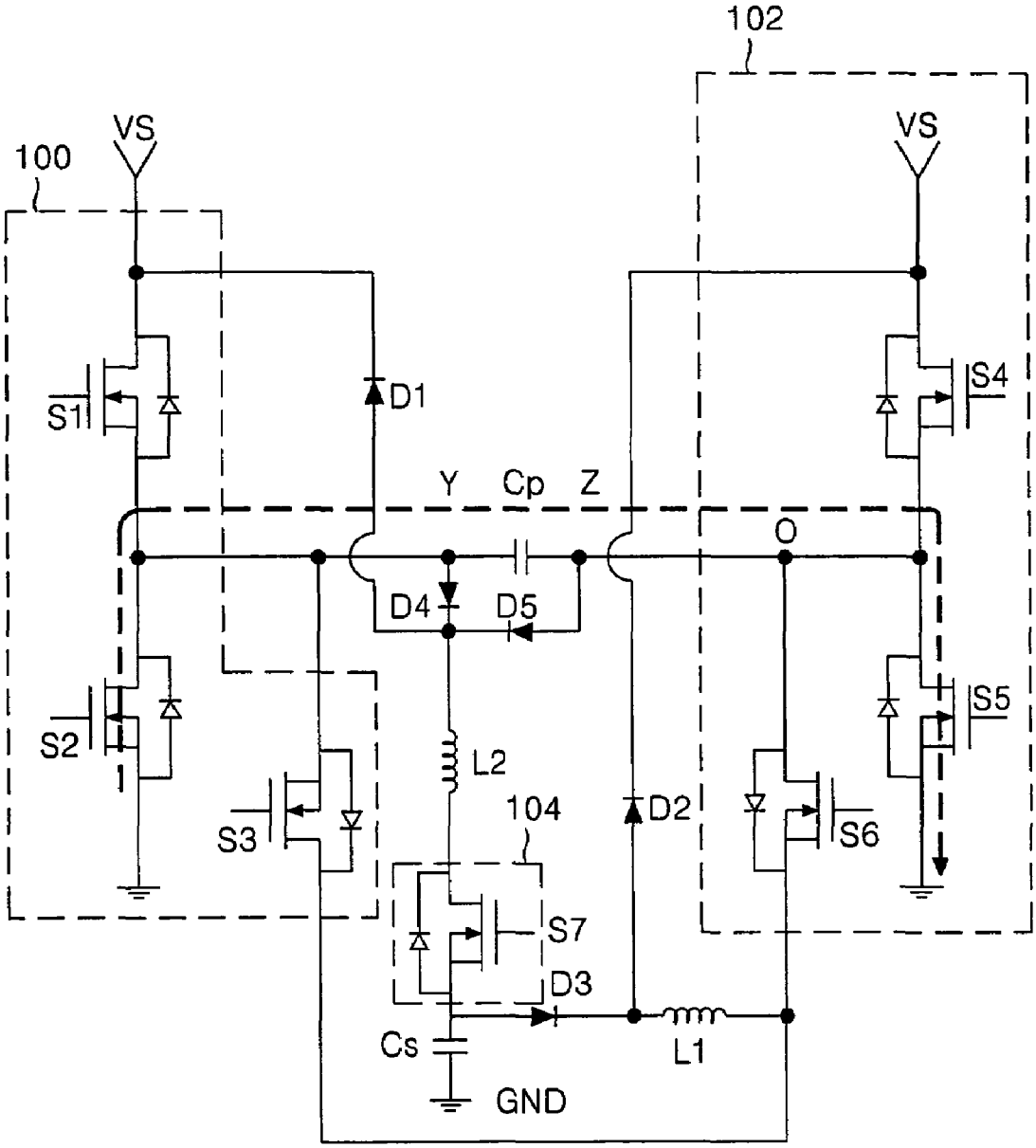
FIG. 13 is a circuit diagram representing a process which the ground voltage is supplied to both ends of the panel capacitor in the energy recovery circuit shown in FIG. 5.

FIG. 6 is a timing diagram representing an on/off timing of switches shown in FIG. 5, and a waveform diagram representing a voltage applied to the panel capacitor. To explain FIG. 5 reference with FIG. 6, it is assumed that a voltage of Vs/2 is charged in the source capacitor Cs.

Referring to FIG. 6, first of all, in a T1 period, the third switch S3 is turned on. When the third switch S3 is turned on, there is formed a current path to a side of the scan electrode Y of the panel capacitor Cp through the source capacitor Cs, the third diode D3, the first inductor L1 and the third switch S3 as shown by a dotted line of FIG. 5. In this connection, since both the first inductor L1 and the panel capacitor Cp form a resonance circuit, a voltage of about Vs is charged into the panel capacitor Cp. And, the fifth switch S5 maintains a turn-on state to form the current path during the T1 period.

In a T2 period, the first switch S1 is turned on and the third switch S3 is turned off. And, the fifth switch S5 maintains the turn-on state during the T2 period. When the first switch S1 is turned on, there is formed a current path to a side of the scan electrode Y of the panel capacitor Cp through the sustain voltage source Vs and the first switch S1 as shown by a dotted line of FIG. 7. In other words, the voltage of the sustain voltage source Vs is supplied to the scan electrode Y of the panel capacitor Cp in the T2 period. The voltage of the sustain voltage source Vs supplied to the scan electrode Y prevents the voltage of the panel capacitor Cp from dropping below the sustain voltage source Vs to cause the sustain discharge to be generated in a normal manner. On the other hand, the voltage of the panel capacitor Cp rises to the sustain voltage Vs in the t1 period, thus the drive power supplied from the outside to generate the sustain discharge is minimized.

In a T3 period, the seventh switch S7 is turned on. And, the fifth switch S5 maintains the turn-on state during the T3 period. When the seventh switch S7 is turned on, there is formed a current path to the source capacitor Cs through the panel capacitor Cp, the fourth diode D4, the second inductor L2 and the seventh S7 as shown by a dotted line of FIG. 8. Then, the voltage charged into the panel capacitor Cp is supplied to the source capacitor Cs via the second inductor L2. At this moment, the source capacitor Cs is charged with the voltage of Vs/2.

In a T4 period, the second switch S2 is turned on. And, the fifth switch S5 maintains the turn-on state during the T4 period. When the second switch S2 is turned on, both sides of the panel capacitor Cp are connected to the ground voltage as shown by a dotted line of FIG. 9. In other words, the T4 period is an idle period between sustain pulses, which are alternatively supplied to the scan electrode Y and the sustain electrode Z. In fact, in the present invention, the sustain pulse is supplied to the scan electrode Y of the panel capacitor Cp while repeating the T1 to T4 periods.

In a T5 period, the sixth switch S6 is turned on and the fifth switch S5 is turned off. And, the second switch S2 is turned on to form a current path in the panel capacitor Cp during the T5 period to a T0 period. When the sixth switch S6 is turned on, there is formed a current path to a side of the sustain electrode Z of the panel capacitor Cp through the source capacitor Cs, the third diode D3, the first inductor L1 and the sixth switch S6 as shown in a dot line of FIG. 10. In this connection, since both the first inductor L1 and the panel capacitor Cp form a resonance circuit, the panel capacitor Cp is charged with a voltage of about Vs.

In a T6 period, the fourth switch S4 is turned on and the sixth switch S6 is turned off. When the fourth switch S4 is turned on, there is formed a current path to a side of the sustain electrode Z of the panel capacitor Cp through the sustain voltage source Vs and the fourth switch S4 as shown in a dot line of FIG. 11. In other words, the voltage of the sustain voltage source Vs is supplied to the sustain electrode Z of the panel capacitor Cp in the T6 period. The voltage of the sustain voltage source Vs supplied to the sustain electrode Z prevents the voltage of the panel capacitor Cp from dropping below the sustain voltage source Vs to cause the sustain discharge to be generated in a normal manner. On the other hand, the voltage of the panel capacitor Cp rises to the sustain voltage Vs in the t5 period, thus the drive power supplied from the outside to generated the sustain discharge is minimized.

In a T7 period, the fourth switch S4 is turned off and the seventh switch S7 is turned on. When the seventh switch S7 is turned on, there is formed a current path to the source capacitor Cs through the panel capacitor Cp, the fifth diode D5, the second inductor L2 and the seventh S7 as shown in a dot line of FIG. 12. Then, the voltage charged into the panel capacitor Cp is supplied to the source capacitor Cs via the second inductor L2. At this moment, the source capacitor Cs is charged with the voltage of Vs/2.

In a T0 period, the fifth switch S5 is turned on. When the fifth switch S5 is turned on, both sides of the panel capacitor Cp are connected to the ground voltage as shown in a dot line of FIG. 13. In other words, the T0 period is an idle period between sustain pulses, which are alternatively supplied to the scan electrode Y and the sustain electrode Z. In fact, in the present invention, the sustain pulse is supplied to the sustain electrode Z of the panel capacitor Cp while repeating the T5 to T0 periods.

As described above, the energy recovery circuit according to the present invention shares one source capacitor Cs and supplies the sustain pulse to the sides of both the scan electrode Y and the sustain electrode Z of the panel capacitor Cp. Further, the voltage, discharged from the sides of both the scan electrode Y and the sustain electrode Z of the panel capacitor, is supplied to the source capacitor Cs via one switch S7. Accordingly, the present invention is capable of minimizing the number of components included in the energy recovery circuit.

Moreover, in the energy recovery circuit and energy recovering method using the same, it is possible to reduce the number of circuit devices formed on the current path. Thus, there is an efficiency reducing a manufacturing cost.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. An energy recovery circuit comprising:

a capacitive load between a first electrode and a second electrode;

a source capacitor to recover energy from the capacitive load via the first and the second electrodes;

a recovery path switch to form a recovery path for supplying energy via the first and the second electrodes from the capacitive load to a side of the source capacitor;

a plurality of charge path switches to control a charge path for supplying energy from the source capacitor to a side of the capacitive load;

a sustain voltage source for generating a high potential voltage of a sustaining pulse;

a first inductor formed on the charge path;

a second inductor formed between the first electrode and the source capacitor on the recovery path;

a first diode coupled between the second inductor and the sustain voltage source;

a second diode coupled between a node of both the source capacitor and the first inductor and the sustain voltage source; and a third diode coupled between the source capacitor and the first inductor.

2. The energy recovery circuit according to claim 1, wherein the charge path switches include:

a first switch connected between the sustain voltage source and the first electrode;

a third switch between the first electrode and one side terminal of the first inductor;

a fourth switch connected between the sustain voltage source and the second electrode; and a sixth switch connected between the second electrode and one side terminal of the first inductor.

3. The energy recovery circuit according to claim 2, wherein the recovery path switch is connected between a node of both another side terminal of the first inductor and the source capacitor and the second inductor.

4. The energy recovery circuit according to claim 3, further comprising a fourth diode connected between the first electrode and the second inductor.

5. The energy recovery circuit according to claim 4, further comprising:

a second switch connected between a ground voltage source and the first electrode; and a fifth switch connected between the ground voltage source and the second electrode.

6. The energy recovery circuit according to claim 4, further comprising a fifth diode connected between a node of both the first diode and the fourth diode and the second electrode.

7. An energy recovery circuit comprising:

a panel capacitor formed equivalently in a scan electrode and a sustain electrode;

a scan electrode driver installed at a side of the scan electrode of the panel capacitor to supply a sustaining pulse to the side of the scan electrode;

a sustain electrode driver installed at a side of the sustain electrode of the panel capacitor to supply the sustaining pulse to the side of the sustain electrode;

a first diode coupled to the scan electrode side of the panel capacitor;

a second diode coupled to the sustain electrode side of the panel capacitor;

a first inductor commonly coupled to the sustain electrode side and the scan electrode side of the panel capacitor;

a path providing part coupled to the first inductor; and a single source capacitor coupled to the path providing part.

8. The energy recovery circuit according to claim 7, further comprising:

a second inductor located between the single source capacitor and the panel capacitor to form a resonance circuit when the voltage is supplied from the single source capacitor to the panel capacitor; and a third diode located between the second inductor and the single source capacitor.

9. The energy recovery circuit according to claim 8, wherein the path providing part includes a switch located between the first inductor and the single source capacitor to be turned on when the voltage charged in the panel capacitor is supplied to the single source capacitor.

10. The energy recovery circuit according to claim 8, wherein the scan electrode driver includes:

a first switch located between a sustain voltage source and the panel capacitor;

a second switch located between a ground voltage source and the panel capacitor; and a third switch located between the panel capacitor and the second inductor to be turned on when the voltage is supplied from the single source capacitor to the scan electrode side of the panel capacitor.

11. The energy recovery circuit according to claim 10, further comprising a fourth diode located between the second inductor and the sustain voltage source to prevent a voltage of the first inductor to rise to greater than the sustain voltage.

12. The energy recovery circuit according to claim 8, wherein the sustain electrode driver includes:

a first switch located between a sustain voltage source and the panel capacitor;

a second switch located between a ground voltage source and the panel capacitor; and a third switch located between the panel capacitor and the second inductor to be turned on when a voltage is supplied from the source capacitor to the sustain electrode side of the panel capacitor.

13. The energy recovery circuit according to claim 12, further comprising a fifth diode located between the first inductor and the sustain voltage source to prevent a voltage of the second inductor to rise to greater than the sustain voltage.

* * * * *